US005860262A

United States Patent [19]

Johnson

[11] Patent Number: 5,860,262

[45] Date of Patent: Jan. 19, 1999

[54] PERMANENT PANELIZED MOLD APPARATUS AND METHOD FOR CASTING MONOLITHIC CONCRETE STRUCTURES IN SITU

[76] Inventor: Frank K. Johnson, 130 Bowdoin St. Suite 505, Boston, Mass. 02108

[21] Appl. No.: 831,572

[22] Filed: Apr. 9, 1997

[51] Int. Cl.[6] ..... E04B 2/44

[52] U.S. Cl. ..... 52/426; 52/428; 52/293.1; 52/294; 52/309.12; 52/698

[58] Field of Search ..... 52/526, 420, 293.1, 52/592.1, 698, 309.12

[56] References Cited

U.S. PATENT DOCUMENTS

| | | | |
|---|---|---|---|
| 4,604,843 | 8/1986 | Ott et al. | 52/426 |
| 4,884,382 | 12/1989 | Horobin | 52/426 |
| 4,972,646 | 11/1990 | Miller et al. | 52/293.1 |
| 5,311,712 | 5/1994 | Accousti | 52/293.1 X |
| 5,367,845 | 11/1994 | Hartling | 52/293.1 |
| 5,459,971 | 10/1995 | Sparkman | 52/426 |
| 5,625,989 | 5/1997 | Brubaker et al. | 52/309.12 |
| 5,701,710 | 12/1997 | Tremelling | 52/428 X |

*Primary Examiner*—Christopher Kent
*Assistant Examiner*—Yvonne Horton Richardson
*Attorney, Agent, or Firm*—Edwin H. Paul; Jerry Cohen

[57] ABSTRACT

A permanent mold apparatus for accepting concrete, and a method of casting buildings and large dimensioned structures monolithically in situ. The mold apparatus encases the monolithic concrete structure, insulates the walls of the cast in situ concrete structure, and provides false ceilings under floor and roof slabs. The concrete is cast continuously to fill the mold apparatus to produce a homogeneous, jointless, protectively encased concrete structure. The mold apparatus includes self supporting panelized footing and foundation assemblies, cavity wall assemblies, column assemblies, truss-girder floor and roof slab platform support assemblies, and internal partition assemblies comprised of interlocking hollow panel members, end plates, perforated tie plates and connecting hubs that mechanically bond together to form a self-supporting, watertight, insulated permanent mold with openings and cavities and platforms into and onto which concrete fill is cast continuously in situ to produce a homogeneous, jointless concrete structure permanently encased and protected by the mold apparatus. The only part of the finished concrete structure not encased may be the floor and roof surfaces. The connection joints of the various panel and connecting members of the mold apparatus are interlocking tongue and grooves which removably slide into one another longitudinally but prevent disconnection in direction other than the longitudinal direction. Flexible filaments are provide that extend outwards from the ends of protruding tongue elements in the interlocking key/keyway assemblies to provide a water tight seal.

37 Claims, 13 Drawing Sheets

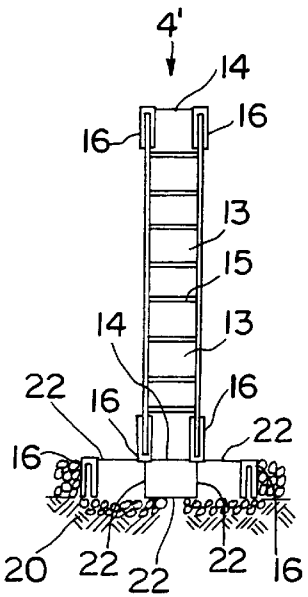
FIG. IC
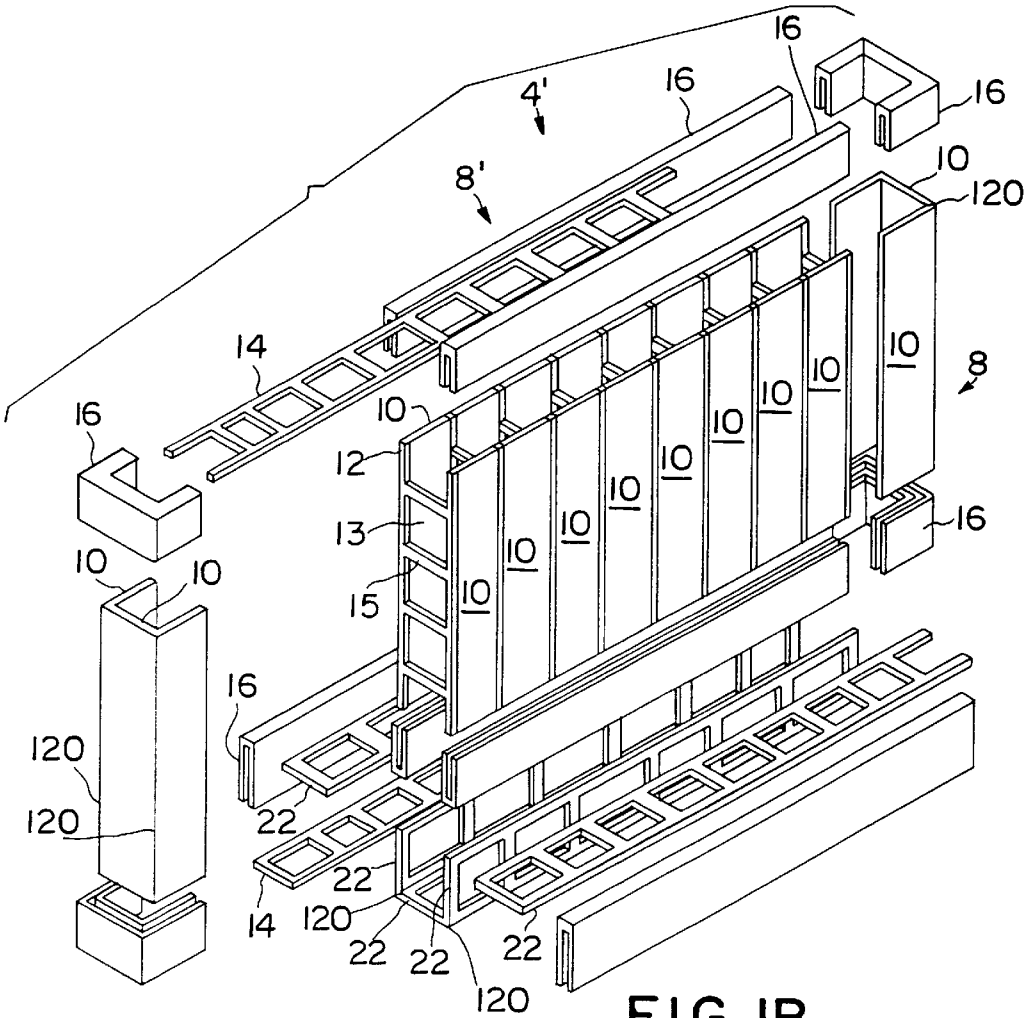
FIG. IB
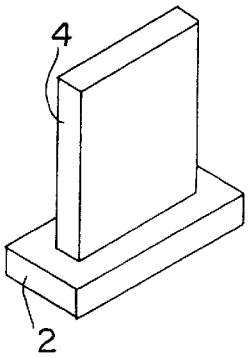
FIG. IA

PERMANENT PANELIZED MOLD APPARATUS AND METHOD FOR CASTING MONOLITHIC CONCRETE STRUCTURES IN SITU

FIELD OF THE INVENTION

The present invention relates generally to the building arts, and more particularly to building encased monolithic concrete structures and buildings including foundations, footings, exterior walls, interior partitions, floor slabs, and roof slabs, including interconnected, interlocking panelized footing and cavity wall assemblies, column assemblies, and flat and pitched truss-girder assemblies that support floor and roof slabs during casting and all together make up a permanent mold apparatus.

BACKGROUND OF THE INVENTION

Concrete is a well known building material that has been used for many years. In most cases a footing or foundation excavation is made and temporary forms of re-usable panels are joined together forming a void into which concrete in its plastic state is placed. Some finishing and/or vibration to remove air pockets and make the exterior surfaces of the concrete smooth is performed before the concrete sets up or hardens. Commonly, steel rods are placed in the void space prior to casting the concrete for additional strength. Types, materials, techniques of use, and actual use of the strengthening steel rods and other such inserts and artifacts through foundations, walls, floors, and roofs are well known in the building arts and are only inferentially discussed herein. The forms are removed when the concrete is hard, and additional structures on top of the concrete foundation wall are built when the concrete is strong enough. Long walls are cast in sections, and the forms are stripped and used for the other sections thereby minimizing the number of forms used. Joints between adjacent sections are made water tight by use of membranes cast into the cold joint between wall sections.

The "foundation" of a building may include a wall, usually beneath the ground level with footing directly under the wall, and a slab adjacent to and/or integral with the footing. Other variations exist as known in the art. Hereinafter, foundation and/or footing refers to such a "foundation." Typically, after the foundation or footing is cast, the foundation forms are removed and temporary wall forms may be erected on top of the foundation. Usually, the strengthening rods extend out of the top surface of the footing so as to be included when the wall concrete is placed. This techniques binds the wall to the footing making a strong joint between the two. After all sections of the concrete wall have been cast and the concrete is hard and strong enough, the wall forms are removed and temporary floor and column forms are erected spanning the distance between the various walls. Shoring supports the forms and the concrete floor slab. The floor forms and shoring are again removed, and the wall forms erected on the hardened floor slab for the succeeding levels. The steps are repeated until the concrete frame of the building is completed.

The process just described for casting concrete structures has many advantages, but some issues remain. For example, since the concrete must sufficiently harden before the next wall section or stage can begin, there is a substantial time delay, normally requiring a week or more between wall sections, floor/roof slab placement on walls, or vertical concrete structures cast on slabs; even though steel rods traverse the horizontal and vertical joints that interface one concrete section to another, the joints exist. The forms must be treated, erected, tied together and braced, and then disassembled after casting and cleaned for each individual concrete placement, concrete joints and interfaces must be sealed and made water tight, the outside and inside surfaces of the concrete often must be insulated, sealed, protected and finished with other materials for esthetic and/or practical reasons, and skilled labor and specialized equipment is often necessary to complete each stage of finishing a concrete structure. The result is that such construction is labor intensive, time consuming and costly.

Thomas Edison, in the early part of this century designed and patented a method for casting a monolithic concrete structure in situ. Several houses were made and remain standing today. The described Edison processes had many limitations. One was that the molds weighed hundreds of tons and were cumbersome, unwieldy, difficult to erect and bolt together. These iron forms presented a significant problem for transporting, assembling and disassembling. Heavy trucks and cranes were necessary to handle the molds.

It is an object of the present invention to provide a method and apparatus for molding, casting and encasing monolithic concrete structures in situ that is both practical and economical.

It is also an object of the present invention to provide a monolithic concrete structure with substantially no cold joints between concrete footings, walls, floors and roofs.

It is another object of the present invention to provide a complete molded or cast concrete structure where the mold is light weight, easily handled and remains in place permanently, such that there is substantially no finishing work necessary for either the interior or the exterior surfaces of the concrete face after the casting operation is completed.

It is yet another object of the present invention to allow a mold for a structure to be self supporting without temporary bracing or shoring and erected in situ, and wherein concrete can be placed into said erected molds substantially continuously. Another object of the present invention is to provide a means for removably connecting adjacent mold panels and components in an interlocking fashion.

Yet another object of the present invention is to provide a water tight, insulated, molded monolithic concrete structure where both interior and exterior faces of the completed concrete walls, and ceilings beneath floor and roof slabs are finished when the casting operation is complete.

Another object of the present invention is to reduce the need for skilled labor, specialized equipment and material storage at the construction site.

Still another object of the present invention is to provide pre-installed utility service lines and outlets in the mold panels prior to erection of the mold at the building site.

Another object of the present invention is to reduce the cost and the time to construct in situ concrete structures.

SUMMARY OF THE INVENTION

The above objects are met by a process and apparatus that can be used to advantage for constructing monolithic concrete buildings in situ including footings, walls, floors, and roofs, and other large structures such as water storage tanks, caissons, columns, bridge superstructures and abutments, deep foundations, piers and other such harbor structures. Additionally the present invention can be used to advantage in constructing concrete or reinforced concrete structures that are part of structures using other materials. Additionally, the present invention in any of the cited or other such applications can be used with reinforcing rods or the like to build reinforced concrete structures.

The inventive apparatus for constructing and encasing the above concrete structures includes molds for an entire structure, including panel assemblies for the footing, vertical walls and horizontal floors or roofs. Canted or inclined roofs may also be constructed using the present invention. Adjoining mold assemblies are removably joined in an interlocking fashion with end plates and tie plates joining opposing mold members to form an assembled mold of the entire structure which is self-supporting. Concrete is poured into the voids of mold in a substantially continuously fashion to form a monolithic concrete structure. The molds are designed to remain in place and form the inner and outer surfaces of the finished concrete structure walls and undersides of horizontal and pitched slabs. Reinforcing steel rods, cages, and the like may used to advantage with the present invention.

The tie plates that traverse and reside finally within the concrete walls, floors, footings, and roofs include large openings or perforations that allow the concrete to flow easily to fill the void of the mold for the entire structure.

The mold assemblies include connecting hubs, tie plates and panels for forming foundations, cavity wall, floor, and roof truss/girder support assemblies with interlocking key and keyway mechanisms along the abutting edges of the panels, tie plates, connecting hubs, and end plates.

An advantage of the present invention is that the molds provide the inner and outer surfaces of the vertical portions of the finished concrete structure and the underside of the horizontal portions, as mentioned above. The molds are joined and interlocked and strengthened to contain the hydrostatic pressures and support the weight of the concrete fill. The keyway mechanisms of the panels and connecting components have filaments to provide a seal making the mold water tight. After casing, the molds provide a protected concrete structure that is substantially maintenance free. The mold panels are, in a preferred embodiment, hollow extrusions where the hollows may be filled with strengthening grouts or insulation or the like. Also, the hollows may be made to serve as conduits for utility service lines.

Large channels or chases may be provided within horizontal mold assemblies for water, heat, electricity, sewage, air conditioning, and other such utility service lines. The vertical utility lines can be placed outside the mold panels or, preferably, within the mold panels.

Other objects, features and advantages will be apparent from the following detailed description of preferred embodiments thereof taken in conjuction with the accompany drawings in which:

BRIEF DESCRIPTION OF THE DRAWINGS

FIG. 1A is an isometric view of the monolithic concrete structure within the mold panels, FIGS. 1B is an exploded view and FIG. 1C an end view of a cavity wall assembly.

DETAILED DESCRIPTION OF PREFERRED EMBODIMENTS

Figure 1D:
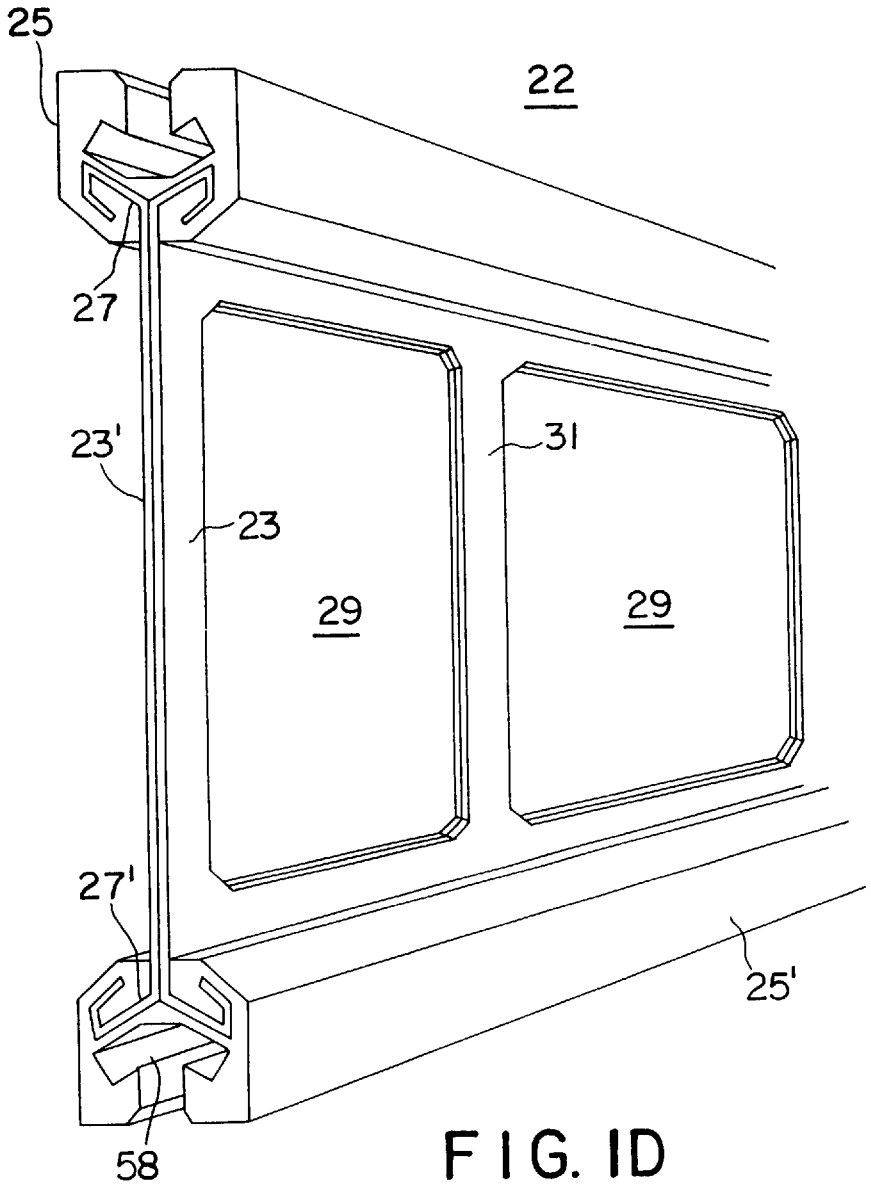
FIG. 1D shows a cross-sectional view of a perforated rolled steel footing plate with rigid plastic edge housings

Referring now to the drawings, in which like numerals indicate like elements throughout several views, and pointing out that all protruding connecting interlocking elements integrally attached to various extruded components are configured to slidably interlock with each other. Some include reinforcing steel. All corresponding connection housings integrally formed within various extruded structural members are likewise identical in configuration and size, and capable of slidably interlocking and engaging all protruding elements.

FIG. 1A shows a view of a completed monolithic concrete wall 4 and footing 2 cast within the mold apparatus of the present invention. The concrete footing 2 is embedded in the ground on crushed gravel and may extend into the earth as required to support the structure. The concrete wall 4 and footing 2 are shown with the mold assemblies removed.

FIG. 1B shows an exploded view of the cavity wall and footing assemblies of a preferred embodiment with no concrete fill. The cavity wall 4' has two opposing panels 8 and 81 that are made up of a series of wall panels 10 that are joined together by vertical tie plates 12. Adjacent wall panels 10 have continuous external surfaces that will serve as the outer surfaces of the combined concrete wall 4 and mold after concrete is placed into the wall cavity between the opposing wall panels. These panels are joined as described later by interlocking t-shaped tongues and grooves or key extensions and mating keyways. There are supporting ladder pieces, or vertical perforated tie plates, 12 that join the ends of the opposing panels 10. These tie plates 12 are perforated with large openings 13 to allow the concrete to freely interact along the length of the cavity wall. These tie plates 12 are made of steel for high strength where the openings and the dimensions of the tie cross members 15 shown in FIG. 1C may be made to the design engineer's specifications. At the ends of the wall 4, solid panels 10 are used to provide a solid continuous end surface for the wall structures shown. At the top and bottom of the cavity wall, tie plates 14 are positioned. The perforations will allow concrete in the wall cavity to freely interact with concrete in the footing, or visa-versa, so that there is no joint between the completed footing and the wall structure. Similarly at the top of the wall the top tie plates will allow concrete to flow from the top of the cavity wall to freely interact with the concrete slab supported by the truss/girder platform (not shown). These top and bottom tie plates are identical and fit using tongues and grooves, as described later, into end plate 16. The end plate fit over and envelope the tops and the bottom edges of the wall panels 10 and extended edges of vertical tie plate 12.

FIG. 1C shows an end view of the cavity wall before a wall panel 10 is installed to form the end of the cavity wall. In this embodiment the perforated footing plate 22 is arranged to extend vertically and horizontally into and along the prepared sub-grade. End plates 16 may be used to define the outside dimensions of the footing. Crushed stone 20 has been deposited and compacted around the footing. The size and depth of the crushed stone is determined by the design engineer based on loading conditions and soil characteristics of the building site. Wider, deeper and longer footings may be provided as is known in the art. Design engineers and/or codes usually require steel reinforcement of footing. In this embodiment the perforated panels 22 are made of steel to complement the steel rods as are known in the art. The rods may extend upwards from the footing into the wall voids. The footing concrete may be placed directly to uniformly fill the entire cavity defining the footing voids up to the bottom of the wall cavity. Concrete fill would then be placed into the cavity wall void from the top of the wall using pumps. As described later, if this structure were of one level of walls and a roof the concrete footings and the walls and the roof would be placed in a substantially continuous fashion in one operation. The roof would be screed in the conventional manner during casting. The concrete is vibrated continuously in accordance with standard practices in the art to ensure consolidation within the voids.

FIG. 1D is a preferred embodiment of the perforated steel footing plate 22 used primarily to connect end plates 16 (see FIG. 1B) at the lower ends of the wall to extend laterally and vertically into the footing and to connect to assemblies that may be in the footings. In a preferred embodiment, the footing plate 22 is comprised of two rolled steel sheets 23 and 23', of a thickness as determined by the design engineer, positioned back to back and held together along common longitudinal edges 27 and 27' by extruded rigid plastic or PVC connecting housings 25 and 25' slidably engaged over longitudinal edges. The longitudinal edges of each steel sheet are bent to form a locking mechanism that securely retains the steels edges within the plastic housings 25 and 25'. In a preferred embodiment the bent portions 27 and 27' are each about one inch long is laid out flat. However, other such lengths and serpentine or sharp angle bending may be used to advantage.

Still referring to FIG. 1D, large openings or perforations 29, preferably twelve inches by twelve inches or more, are cut or stamped out of the sheets. A rung or ladder-like connections 31 of approximately one inch separates the openings 29.

Still referring to FIG. 1D, the connecting housing 25 and 25' are made of a rigid plastic extrusion about 1 inch wide and 1 inch thick. A keyway channel 58 is formed along the longitudinal edges of the plate 22. This keyway is constructed in the t-shaped design to accommodate and mate with the corresponding t-shaped extensions of the other apparatus described herein.

In the preceding operation the concrete fill is preferred as lightweight structural concrete of Portland cement with light weight aggregates, water, air entraining and high range water reducing admixtures and other such admixtures, known in the art, that minimize shrinkage, accelerate set up time, and resist freezing. Such concrete mix design is readily available in the marketplace. The resulting concrete mix design meets the design engineer's performance and compressive strength requirements and weighs between 90 and 110 pounds per cubic foot. Addendum A is a specification of a preferred lightweight concrete that may be used to advantage with the present invention. Other concrete compositions may be used in other preferred embodiments.

In practice the hydro-static pressure of the concrete is known as are: the concrete composition and weight, setup times, the ambient temperature, liquid content, vibration practices and the strength of the mold pieces. By knowing these parameters and the dimensions of the structure involved, the placement of concrete fill can proceed at a rate that will prevent concrete fill placed in the cavity walls from forcing footing concrete pushing up through the footing's open top, and prevent the cavity wall assemblies from bursting at the wall bottom. In a preferred embodiment hydro-static pressures are held to less than 800 pounds per square foot (psf). The footing concrete is typically made with a slump of two inches, which is relatively stiff or thick, while the wall concrete is a somewhat less stiff mixture being made with a slump of less than four inches, typically.

The extruded members of the present invention are made from PVC or or other such plastic resins mixed with additives such as smoke suppressants, ultraviolet stabilizers, and colorants made to meet code requirements and market conditions. The external surfaces of the panel are meant to form the outer and inner finished surfaces of the completed concrete wall structure and are designed to meet the applicable standard codes. PVC plastic is rigid, economical, flame retardant, strong, and resistant to water, salt, oxidizing agents, reducing agents, detergents, most oils, fats, alcohol and gasoline. These qualities make PVC plastic an excellent material for protecting the surfaces of the load bearing concrete walls and columns.

Other materials used in the present invention which may become permanent load bearing members, as described later, are preferably protrusions made of fiberglass-reinforced polyester.

Figure 2A:
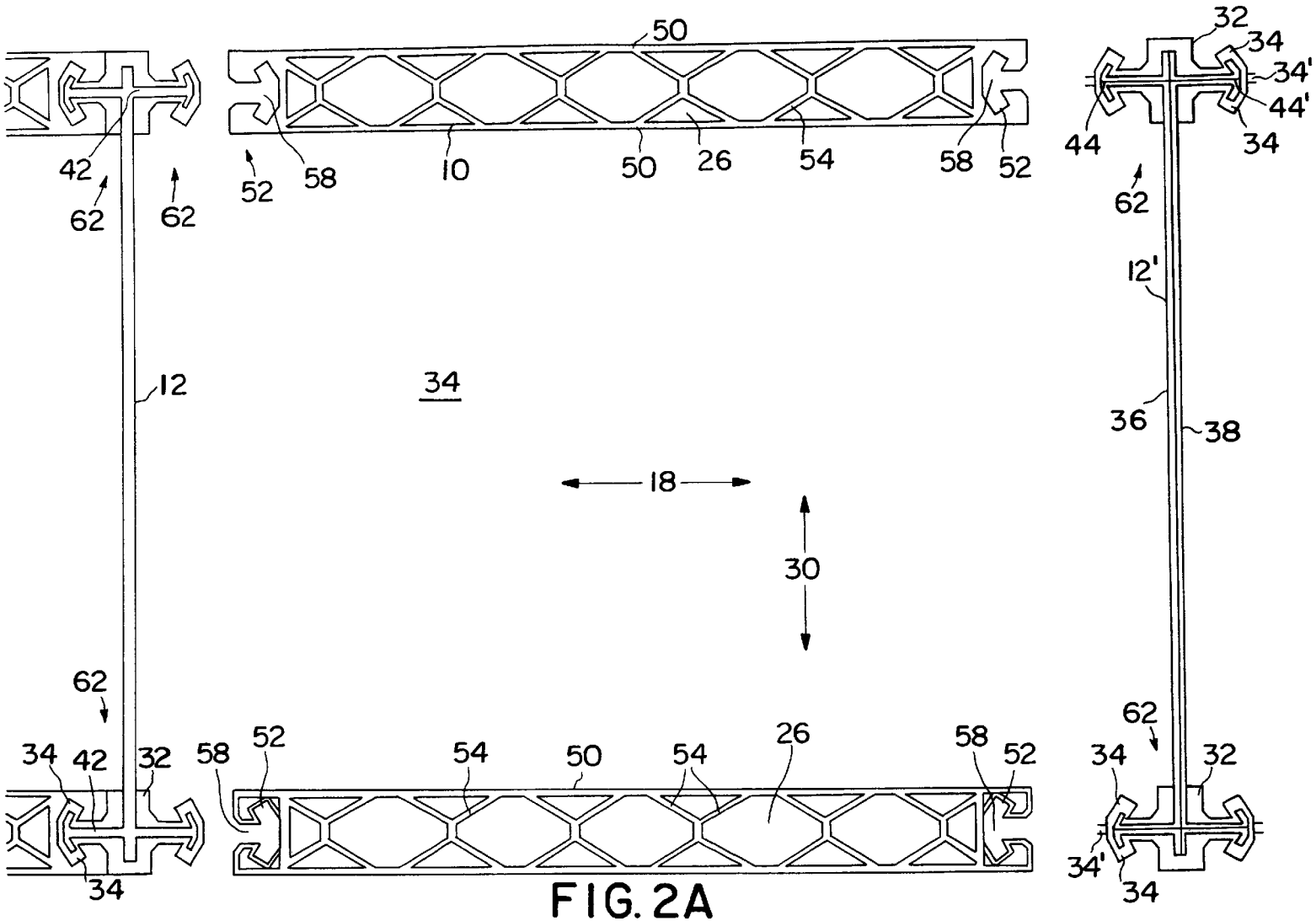
FIG. 2A is cross sectional plan view of a cavity wall structural module.

FIG. 2A shows a plan view of a void in a wall cavity module. looking down (or up) at the sectioned ends of the opposing walls panels 10 and two vertical tie plates 12 and 12'. A preferred embodiment includes the wall panels being an extruded hollow core wall panel 10. The extruded panel member is preferably made creating interstices 26 that exist along the entire vertical length (see FIG. 1B) of the wall panels 10. These interstices can be filled with high strength grout, as known in the art, to provide stronger, more rigid wall panels 10.

Still referring to FIG. 2A, the wall panels 10 consist of two parallel outer walls 50, preferably about ⅛ inch thick joined by a honeycomb-configured web 54 of 1/16 about thickness. The wall panels are about one and one-half inches total thickness and vary from between eleven and eighteen inches in length 18. The height of the wall panels varies according to the design engineer's specifications. The lateral distal ends 52 of the wall panels 10 are extruded forming a female keyway 58 constructed and arranged to accept a corresponding male key 62 to form an interlocking connection. The keyway 58 shown is formed with a t-shape that -extends laterally into the interior of the wall panels. The wings of the t-shaped keyway 58 droop in this embodiment, but many other configurations and variation in shape may be used to advantage with the present invention. Preferably overall depth of the keyway is in the order of an inch and one-half. However, other depths can also be used to advantage.

Still referring to FIG. 2A, the perforated tie plates 12 and 12' are shown connecting the opposing ends of the panels 10. Tie plate 12 is made, preferably, of 22 gauge or thicker rolled steel, depending upon the design engineer's specifications. The spacing 18 of the tie plates to each other may be determined by the design engineers specifications. One foot on center is a common spacing 18 for a concrete wall thickness 30 of eight inches. Tie plate 12 has a span of about inner width of the wall 30, and is terminated at the distal ends by steel extensions 42 and 42'. Tie plate 12' has corresponding double t-shaped extensions 44 and 44'. These t-shaped extensions are each encased in extruded plastic double t-shaped connecting flange 32. The plastic joints made by the keyway or tongue-in-groove locking mechanism also form a watertight joint by making the keyway/key with proper dimensions as known in the art and by co-extruding a flexible filament or membrane 34' onto the outer surface of the key spanning the void between the key body and keyway frame. These extruded extensions 34 and co-extruded filaments 34' have longitudinal dimensions equal to the vertical length of the wall panels 10. In this manner there is a continuous wall surface 8 (see FIG. 1A) that traverses many wall panels and vertical tie plates that provides a substantially water tight integral wall. The tie plates 12 and 12' prevent the adjacent cavity wall panels 10 from separating laterally, and hold the opposing cavity wall panels together longitudinally with one another, when concrete fill is placed or cast into the void. The tie plates also provide tensile reinforcement strength in the completed concrete wall.

The tie plate 12' shows another preferred embodiment of a tie plate construction. Here a first steel sheet 36, rolled to form two spaced apart identically shaped T configurations 44 and 44'. A second steel sheet 38 identical to sheet 36 is formed and placed and bonded back to back with sheet 36 to form the composite steel tie plate 12'. The bonding of such sheets is known in the art.

The extruded flange 32 encasing the ends of the tie plates is formed into the mating key shape described above. A wall panel 10' is shown joined and interlocking to the vertical tie plate 12.

Figure 2B:
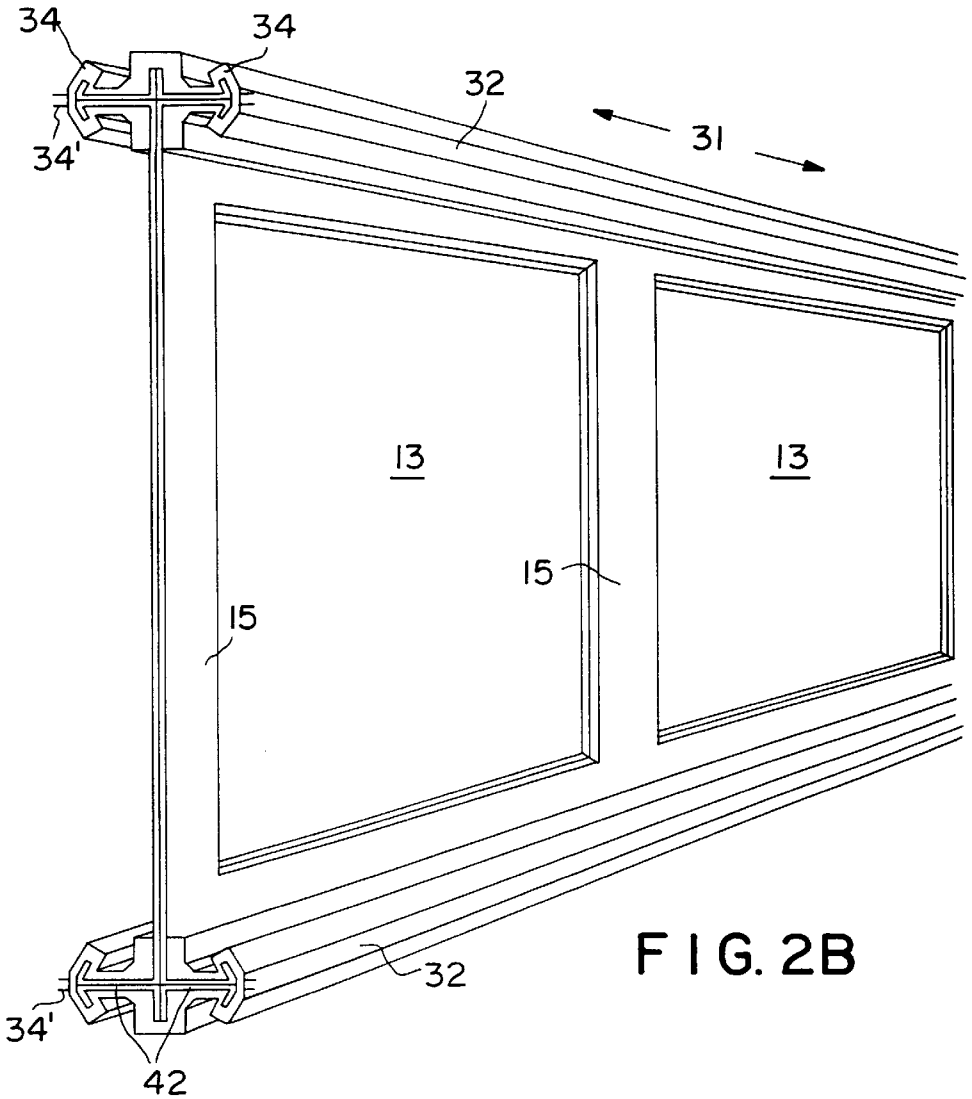
FIG. 2B is a perspective view of a vertical metal tie plate used in the cavity wall of FIG. 2A.

FIG. 2B shows a perspective view of the vertical tie plate 12 and the connecting flanges 32. The connecting flanges 32 are extruded to equal the vertical height 31 of the wall panels so as to form a continuous wall structure. This height will vary according to the design engineer's specifications. The tie plate 12 itself may be of the same vertical height need not be of a vertical length equal to that of the wall panel 10 or the extruded connecting flanges 32, but may be sectioned into various lengths depending upon the application. The tie plate 12 has apertures 13 that allow concrete to pass freely and interact therethrough. The apertures may be one foot by one foot or other sizes as may be determined by the design engineer. The rungs 15 are preferred to be one and one-half inches wide, but other widths can be used.

Referring back to FIG. 1B, the top and the bottom of the cavity wall are terminated by an assembly of an end plate 16 over the top and the bottom of each wall panel, a top tie plate 14 connecting the opposing end plates. The bottom end plates are the same end plates used on the top except inverted. Such an assembly suitable for the top or the bottom of the cavity wall is shown in FIG. 3.

Figure 3:
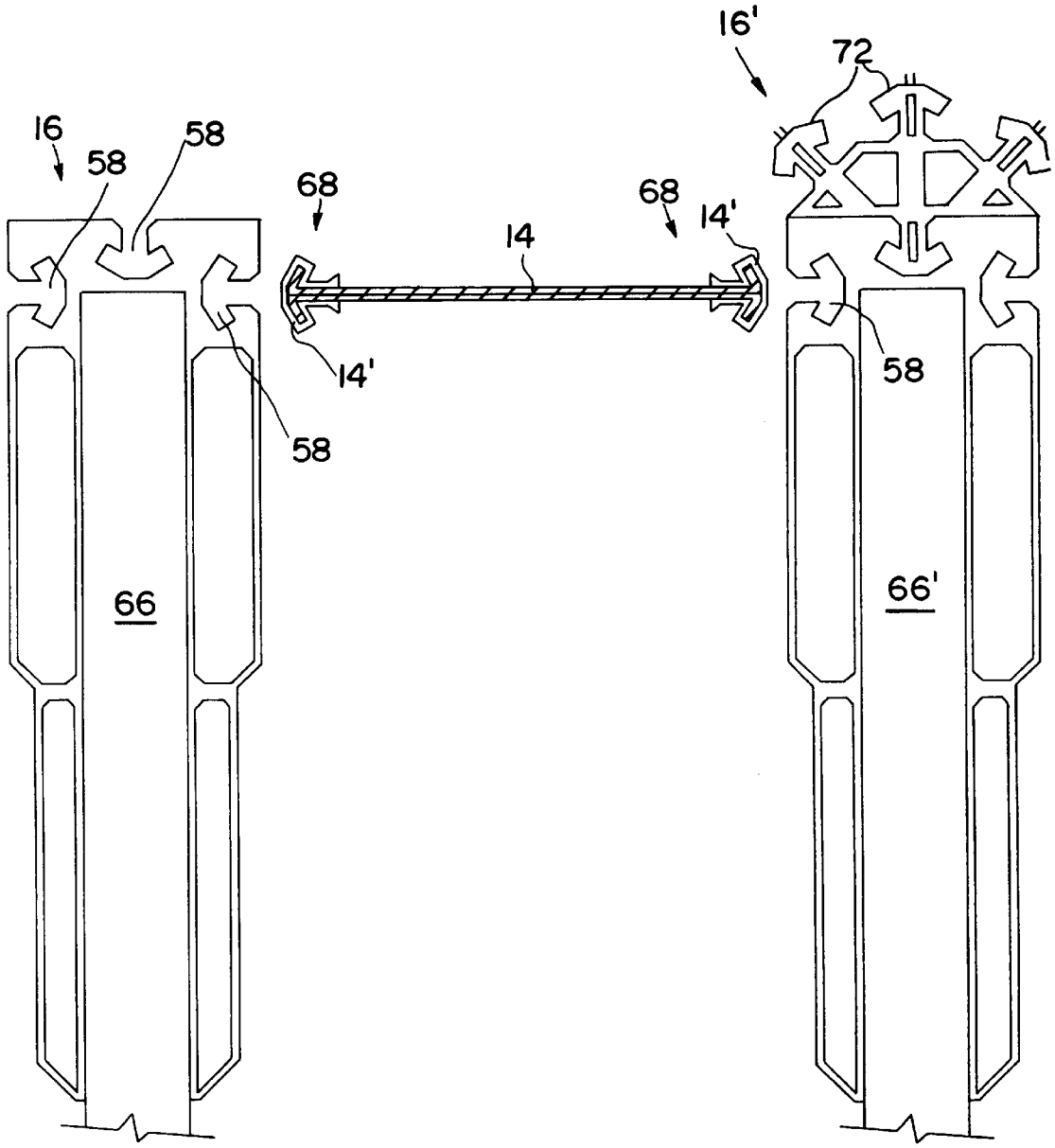
FIG. 3 is a cross-sectional view of the top of a cavity wall assembly showing end plates and a horizontal, perforated metal tie plate.

FIG. 3 shows an end view of an assembly that would fit over the top (or the bottom) of the cavity wall. Each end plate 16 is made of extruded PVC that defines a channel 66 made to matingly fit over the width of the wall panels. Preferably the channel 66 is about 1 and ½ inches wide. The two opposing end plates 16 and 16' are connected to each other by the top tie plate 14. The top tie plate is steel construction similar to the above described tie plates, but each end of top tie plate 14 has a single t-shaped flange 68 of steel with a PVC or a fiber glass connecting flange 14'. The flanges fit into mating t-shaped keyways 58 formed into the top edges of the facing surfaces of the end plates. The t-shaped 68 flanges provide a key that matingly fits into the keyways 58 thereby retaining the end plate 16 to each other. The end plates 16 have two other keyways formed for joining to other extruded assemblies as described later. A four way hub with connecting elements 72 that match the keyways 58 is shown mounted to one of the end plates.

As described before, and as may be required by the design engineer, reinforcing steel cages are sized and placed in the footing assembly cavity, horizontal steel rods are sized and inserted as directed by the design engineer inside footing and the cavity wall assembly voids, and steel reinforcing mats are installed on the truss/girder support platform assembly, described later, in the conventional manner using chairs and other devices to hold the steel mat above the platform and secure it in the desired position and location. As described before, high strength grout may injected into the hollows of the panel members and hubs and allowed to set up to increase rigidity of cavity wall modules. Standard window assemblies, door assemblies, and other inserts (not shown) requiring wall and floor framed openings that have been specified by the designer and manufactured by others are installed prior to commencing the casting operation. All such assemblies and inserts are pre-attached to either a wall panel member or fitted with t-shaped connecting elements 72 which allow easy installation and ensure the structural and watertight integrity of the present invention.

Using concrete pump trucks as required, concrete fill is cast uniformly within voids along the entire length of the cavity wall assembly. Pumping concrete fill into the void at several locations at the top openings in the wall simultaneously provides uniform placement and loading of the concrete throughout the entire mold apparatus and prevents separation of the concrete ingredients that occurs when concrete fill is freely moved any significant distance vertically or laterally.

When the level of fill reaches the top of the footing assembly void, concrete placement begins from the top of the cavity wall, and continuing without interruption, until the void of cavity wall and column assemblies are completely filled. Concrete is vibrated using conventional means to ensure consolidation within the enclosed space. The rate of placement when the top of the footing is reached may be changed to accommodate the transition from the footing to filling the wall voids. The new rate is determined by knowing the set up time of the concrete used in the footing and allowing enough time, by say reducing the pour rate, for the footing to set up enough such that concrete meant to fill the wall voids does so and does not force the top surface of the footing concrete to rise above its design level. It is noted that the composition of the concrete may vary between the footings and the walls as known in the art. Such changes in composition would be factored into the calculation of the placement rates as the transitions from horizontal components of the mold to the vertical components of the mold. The same technique is used when a second level floor is filled and the walls of the second story are being filled. The rate of placement is changed to ensure that the concrete meant to be filling the second story cavity walls does just that and does not force the concrete slab elevation to rise above its design depth. By adjusting the liquidity or slump of the concrete being placed and the other parameters, known in the art of placing concrete, the design engineer can calculate the various placement rates as the different parts of the mold are filled. For example, in a typical eight inch thick wall using standard mix designs for lightweight concrete and under typical environmental and other such conditions, the placement rate into the cavity wall may proceed at about one foot vertical height per hour. In this example the wall concrete four feet beneath the present level of the concrete will have set up enough such that only the most recent four feet of concrete exerts a hydrostatic pressure that must be borne by the mold. This pressure will, in this example, be no more than 800 pounds per square foot. When a footing or upper level floor is being cast, the placement rate after the footing or floor is cast may be reduced to one or two inches an hour for the next four hours or so, and then the one foot an hour rate resumed. During this placement of concrete fill it is important to not allow the top level of the cast concrete to set up before additional fill is added since a joint could then be formed. Replacing ready mix concrete trucks and availability of men and equipment to maintain uniform placement of concrete fill are some of the possible causes of short delays. However, such delays will not harm the process as long as the delay is substantially less than the set up time for the concrete.

Casting or placement continues as described above, without substantial interruption when the level of fill over flows the top of the cavity wall and column assemblies and starts to build up to the specified depth uniformly on top of the truss/girder support platform assembly. Workers screed the concrete in the conventional manner to ensure placement is of the design thickness and the specified gradients are realized. Casting continues without interruption by placing concrete fill into voids in the next level cavity wall and column assemblies from the top of the assemblies that connect directly to the truss/girder roof platform assembly. Once the casting operation is completed, the structure is allowed to set up and gain its required strength as determined by testing concrete samples before imposing any live loads on the horizontal surfaces.

Concrete fill in the preferred embodiment is lightweight structural concrete with admixtures that minimize shrinkage, accelerate set up time, resist freezing, and result in a unit weight of between 90#/ft3 and 110#/ft3—typically available at local ready-mix plants. Conventional ready mix concrete consists of Portland cement, lightweight aggregates, water, air entraining and water reducing admixtures and other admixtures specified by the design engineer in order to achieve performance criteria during casting operations and compressive strength requirements of the completed structure. See Appendix A.

Figure 4:
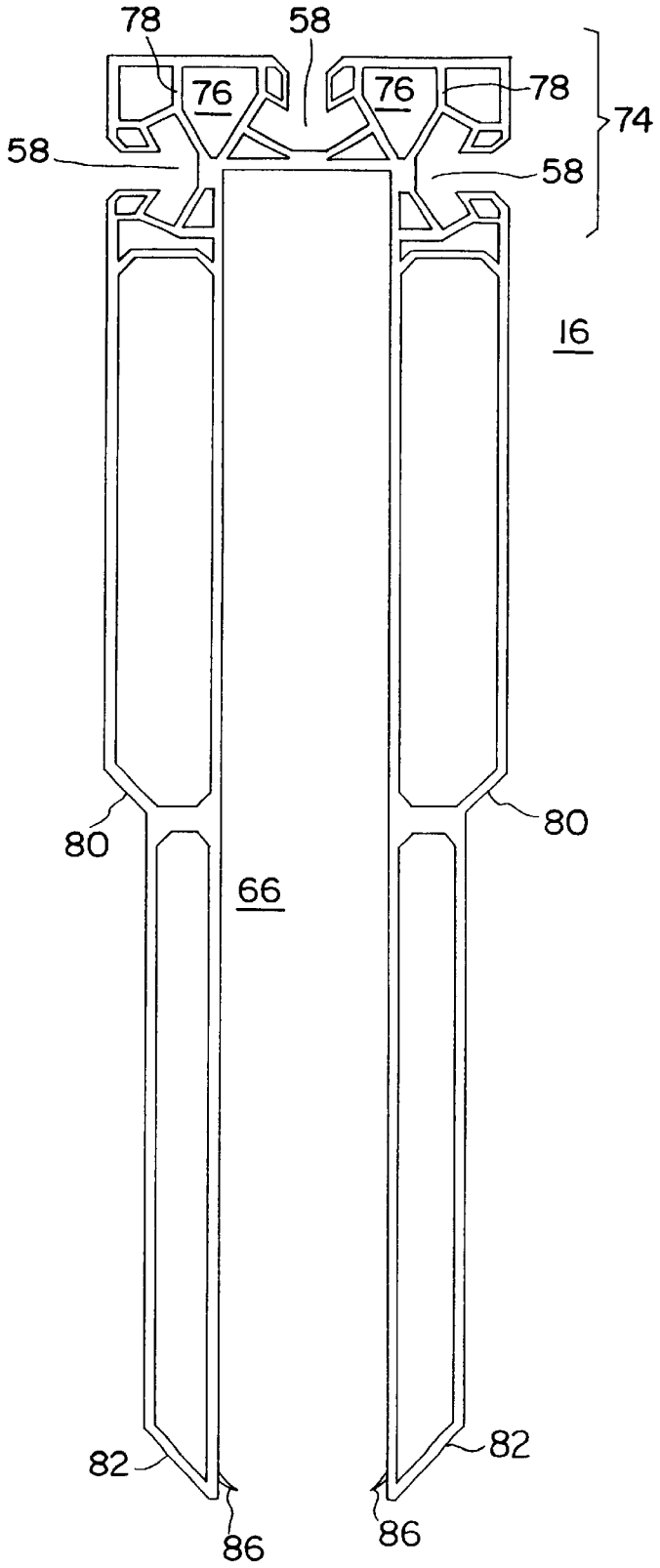
FIG. 4 is detailed cross-sectional view of an extruded end plate showing housings.

FIG. 4 shows a detailed cross-section of an end plate 16 shown in FIGS. 1*b*, 1C and 3. In a preferred embodiment, the head portion 74 of the end plate is generally square with three indented t-shaped keyways 58 arranged on each side and at the top of the head portion. The keyway channels are about 1'/4 inch wide. These keyways are identical with the keyways of FIG. 3 and are designed to accept the same t-shaped extensions. Within the head portion webbing 78 of about 1/16 inch thickness provides strength and rigidity. There are voids 76 formed which may be filled with strengthening grout or insulation or other materials as desired or specified. The exact configuration of web reinforcement is specified by the design engineer.

Still referring to FIG. 4, the side walls of the end plate extend downward for about a foot with a stepped angle taper 80. The sides end with an angled taper 82. Other dimension may be designed suiting the strength and esthetics. The side walls are spaced forming a channel 66 constructed to snugly fit over the wall panels. In a preferred embodiment, flexible, impervious filaments 86 extend from and are co-extruded with the lower inner wall of the sides. These filaments protrude into the space 66 by approximately 3/32 inch to form a seal with the wall panel when the wall panel is inserted into the channel 66.

Figure 5:
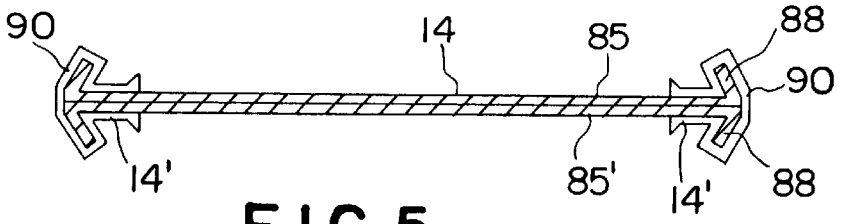
FIG. 5 is a cross-sectional-view of horizontal perforated rolled steel tie plate.

FIG. 5 shows a cross section of the preferred embodiment of the two element perforated top tie plate 14 of FIGS. 1B and 3 used primarily to connect two parallel end plates 16 together. The t-shaped extensions at the ends 14' of the top tie plate 14 fit into mating keyways, see item 58 in FIG. 4, formed in the opposing side walls of two parallel extruded end plates 16, see FIG. 1B. Top tie plate 14 is comprised of two channel shaped rolled steel sheets 85 and 85' held together back to back by methods known in the art by a PVC extruded sleeve 14' that slidably engages the lateral t-shaped bends 88 at the ends of the tie top plate 14. The steel sheets may be bonded together by welding or other means known in the art. In a preferred embodiment, two parallel spaced apart flexible, impervious filaments 90 are co-extruded from the outer most surface of the head portion and protrude outward by approximately 3/32 inch. These filaments interferingly engage the mating keyways into which the ends 14' are inserted. The filaments provide a water tight seal.

FIGS. 6–16 show structural members that are used to assemble more elaborate structures that are needed for erecting and connecting multiple assemblies together to form the vertical and horizontal elements of a complete house or structure. The structures themselves are shown in FIGS. 17–19.

Figure 6:
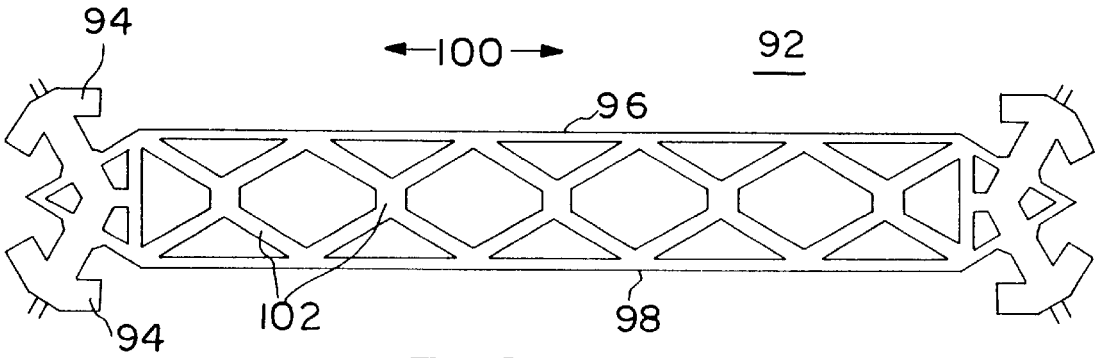
FIG. 6 shows a cross-sectional view of a hollow core truss/girder web connecting plate with dual t-shaped keys formed along each edge.

FIG. 6 shows a cross-section of a preferred embodiment of a hollow connecting plate 92 used for connecting diagonal web members together between upper and lower chords of a truss/girder assembly described later. In a preferred embodiment, two t-shaped elements 94 protrude from each end of the plate 92. Each element 94 defines an angle of about at 60° relative to the plane of the plate. The connecting plate 92 is comprised of two parallel exterior walls 96 and 98, each wall about 1/8 inch thick. The walls are integrally tied together by honeycomb webbing 102 about 1/16 inch thick. The width 100 of the connecting plate 92 is preferably about six inches and is preferably an extrusion of rigid PVC plastic.

Figure 7:
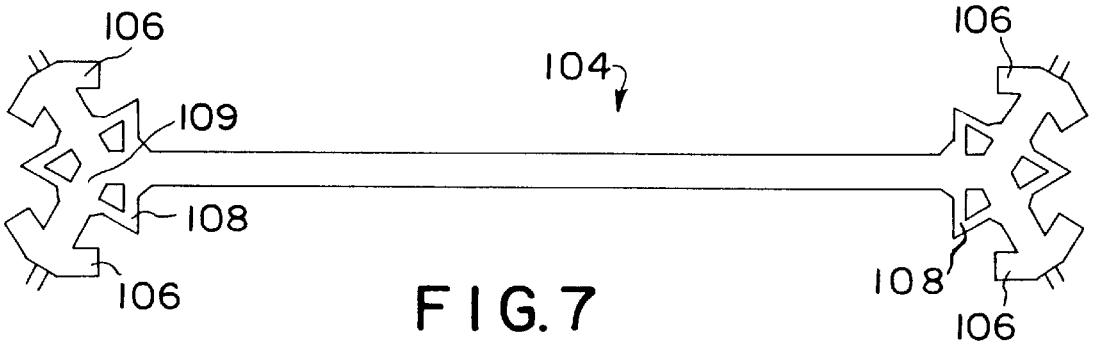
FIG. 7 shows a cross-sectional view of a perforated truss/girder web connecting plate with dual t-shaped keys formed along each edge.

FIG. 7 shows a cross-section of a preferred embodiment of a perforated PVC connecting plate 104 used to connect diagonal members together in the truss/girder assembly described later. In this preferred embodiment, two t-shaped elements 106 protrude from each end of the plate 104. Each element 106 defines an angle of about at 60° relative to the plane of the plate. Still referring to FIG. 7, the body of the plate 104 is preferably a quarter inch thick rigid PVC plastic sheet. The sheet in the direction into the page is perforated (not shown) with openings twelve inches by five inches wide separated by 1 inch wide bridges or rungs. The plastic connecting plate is preferably an extruded continuous structural member with stamped openings or perforations manufactured of rigid PVC plastic. The t-shaped elements extend from triangular shaped bodies 108 at each end of the flat plate section of the connecting plate. These triangular shaped bodies are constructed preferably with quarter inch thick webbing.

Figure 8:
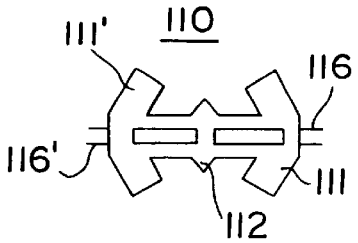
FIG. 8 shows a cross-sectional view of an extruded I-section connecting hub.

FIG. 8 is a cross section of a preferred embodiment of two element I-section connecting hub 110. The hub is a rigid PVC extrusion with two opposed t-shaped elements 111 and 111' integrally protruding from base 112. These t-shaped elements are constructed and arranged to matingly fit with corresponding keyways 58 described herein, and especially with the end plates, the various tie plates and other structural members described herein. In a preferred embodiment, two parallel spaced apart flexible, impervious filaments 116 and 116' are co-extruded from the outer most longitudinal surface of elements 111 and 111' and preferably protrude outward approximately 3/32 inch.

Figure 9:
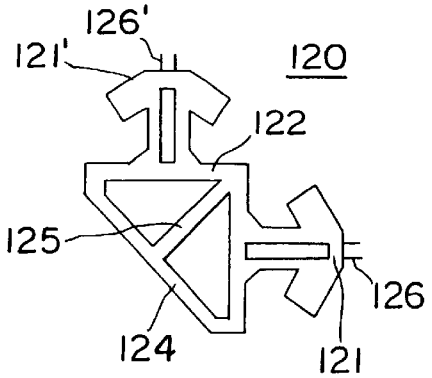
FIG. 9 shows a cross-sectional view of an extruded corner connecting hub.

FIG. 9 is a cross section of a preferred embodiment of two element corner or ninety degree connecting hub 120. Connecting hub 120 is a rigid PVC plastic extrusion consisting of two t-shaped elements 121 and 121' integrally attached to the right triangle shaped hollow body 122. The two t-shaped elements protrude along axes 90° relative to each other. The t-shaped elements are configured to matingly interfit with corresponding keyways described herein. Two parallel spaced apart flexible, impervious filaments 126 and 126', are co-extruded from the outer most longitudinal surface of the t-shaped elements and protrude outward approximately 3/32 inch. The body cavity walls 124 are preferably 1/8 inch thick. The body 122 is a hollow right triangular shaped body with an internal reinforcing web 125.

Figure 10:
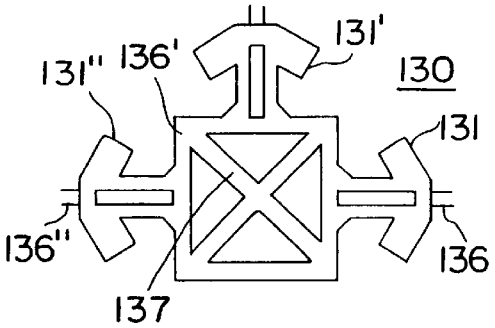
FIG. 10 shows a cross-sectional view of an extruded t-section connecting hub.
Figure 11:
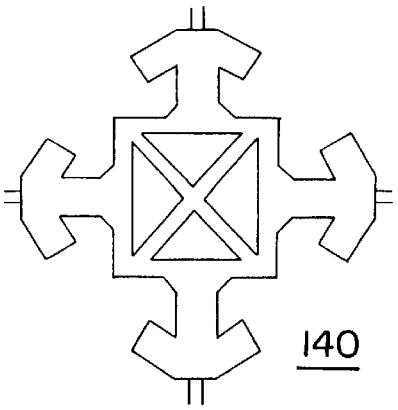
FIG. 11 shows a cross-sectional view of an extruded 90° X-section connecting hub.
Figure 12:
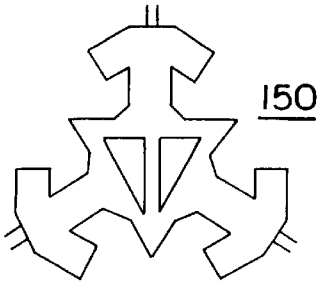
FIG. 12 shows a cross-sectional view of an extruded 120° Y-section connecting hub.
Figure 13:
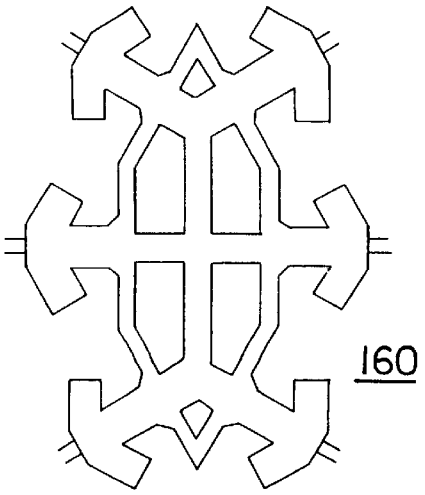
FIG. 13 shows a cross-sectional view of an extruded 60° truss/girder top chord connecting hub.
Figure 14:
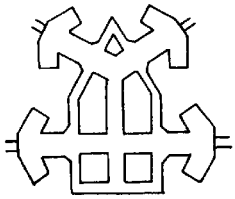
FIG. 14 shows a cross-sectional view of an extruded 60° truss/girder bottom chord connecting hub.

FIG. 10 is a cross section of a preferred embodiment of a connecting hub 130 having three t-shaped elements made of a rigid PVC plastic extrusion. The three t-shaped connecting elements 131, 131' and 131" integrally protrude from cavity walls of a square shaped hollow body 130 at 90° to each other. The t-shaped elements are configured identically to the t-shaped elements described herein. As with the other t-shaped elements, two parallel spaced apart flexible, impervious filaments 136, 136', and 136" are co-extruded from the outer most longitudinal surface of the t-shaped elements and protrude outward approximately 3/32 inch. The body 130 has reinforcing webbing 137 of preferably 1/16 inch thickness.

FIGS. 11, 12, 13, 14, and 15 are cross sections views of other preferred embodiments of hubs with t-shaped extensions positioned at various angles relative to each other. All the t-shaped elements are designed to mate with the keyways 58 described herein, and the extreme ends of all the t-shaped elements have co-extruded filaments designed to make a seal in the various keyways when joined together with the keyways. In each case the bodies are hollow with reinforcing webbing. The dimensions of the various parts of these structures may be made different to accommodate the requirements as determined by the design engineer.

In some cases lubrication, e.g. graphite, may be placed in the t-shaped keys and keyways of any of the members described herein to facilitate the interconnection of longitudinally sliding the t-shaped keys into the keyways.

Figure 16:
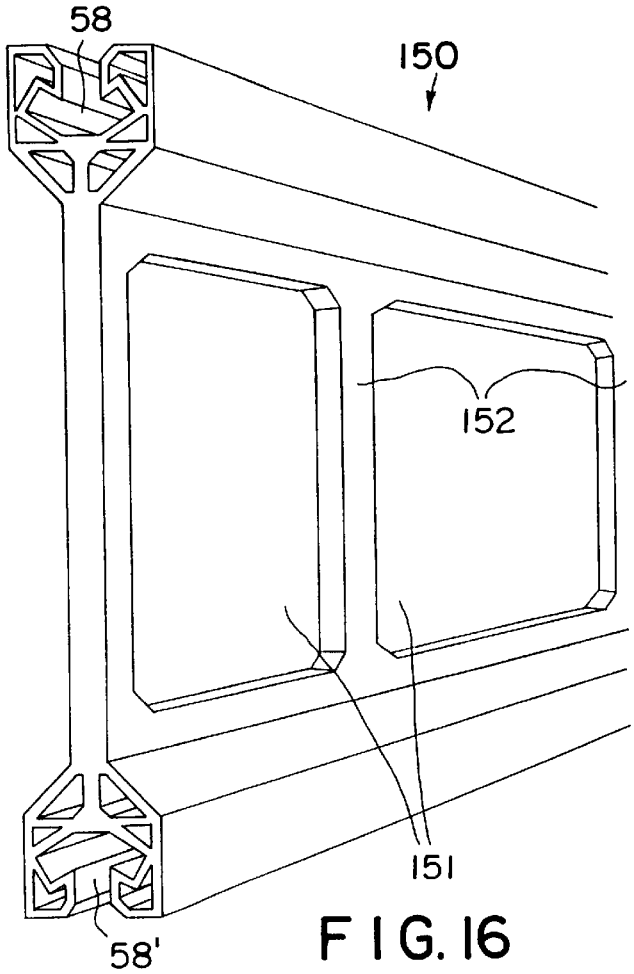
FIG. 16 shows an isometric view of a perforated truss/girder web connecting plate with molded in edge keyways.
Figure 15:
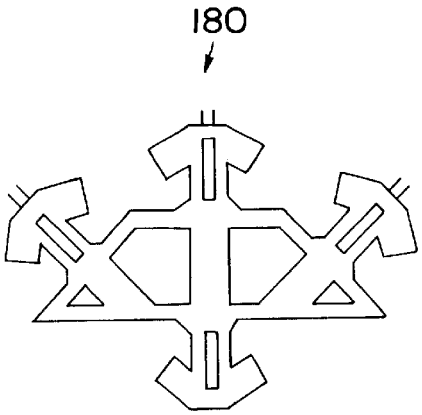
FIG. 15 shows a cross-sectional view of an extruded 60° truss/girder end plate connecting hub.

FIG. 16 is a cross section of a preferred embodiment of perforated connecting web plate 150 used in a truss/girder assembly described later. In a preferred embodiment, the web plate consists of a half to three quarters inch thick extrusion of rigid PVC plastic forming keyways 58 and 58' integrally formed along longitudinal edges of the panel. Large openings or perforations 151 are preferably 18 inches long by 12 inches in wide are cut or stamped out of solid flat center panel section. Rungs 152 of approximately 1 inch form a ladder-like array and separate the openings. The keyways 58 and 58' are extruded with and form the edges of the flat plate portion of the web plate 150. As the keyway structures are formed with a hollow section that may have webbing for added strength. The keyways are designed, constructed and arranged to mate with the various t-shaped extensions and elements described herein.

Figure 17A:
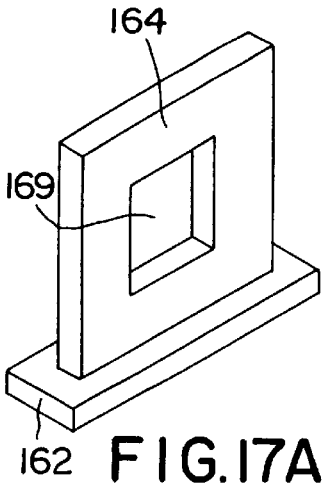
FIG. 17A is an isometric view of the monolithic structure cast within the mold assembly
Figure 17B:
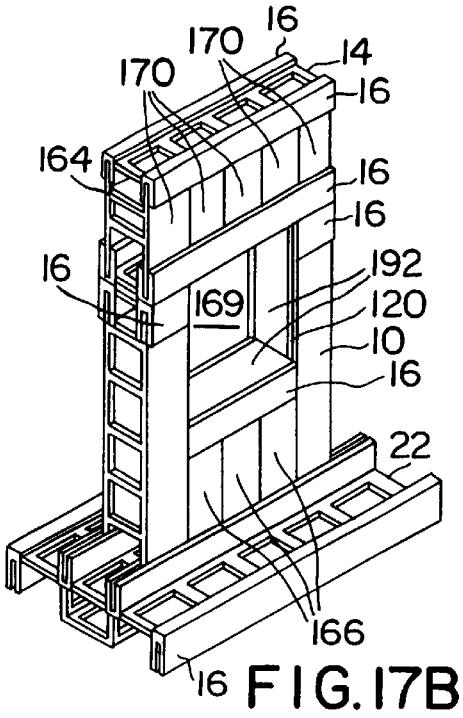
FIGS. 17B, 17C, and 17D are views of a framed window opening in a cavity wall section.
Figure 17C:
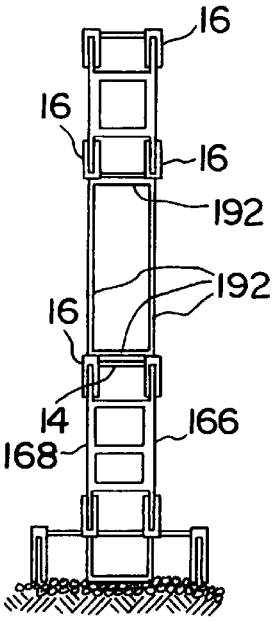
Figure 17D:
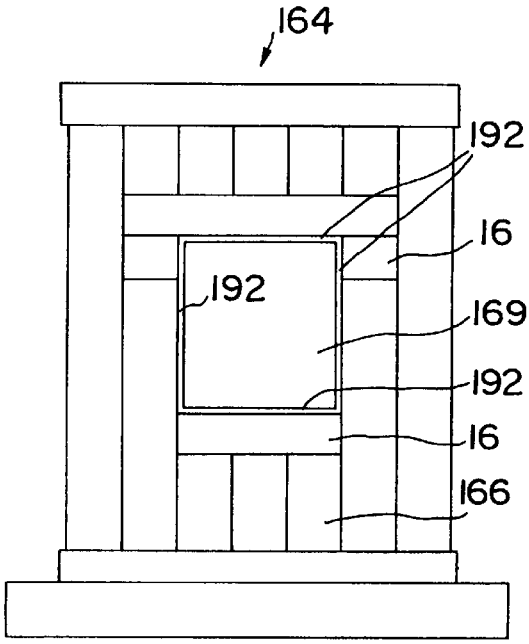

FIG. 17A shows an isometric cross-sectional view of the concrete wall and footing with the mold assemblies removed of FIG. 1A with a window opening 169 in the middle of the cavity wall. The footing assemblies 162 and the upper cavity wall assembly 164 are identical with the footing and top of the cavity wall assemblies of FIG. 1A and only the artifacts concerning the window opening 169 will be discussed here. With reference to FIG. 17B, an isometric view showing the mold assembly elements around the window opening itself, the bottom of window opening includes an end plate 16, placed on top of wall panels 10, which are shortened versions of the wall panels 10 in FIG. 1B. Another end plate 16 lies across the top of the window opening and across the wall panels 10 adjacent to the sides of the window. The end plate 16 above the window, in this preferred embodiment, supports additional wall panels 10 which rise to the top of the cavity wall. The inner exposed surfaces of the window frame are formed of shortened wall panels 10 connected to end plates 16 by corner hubs 120. The various elements needed to form the cavity wall with a window opening are attached to each other by hubs and tie plates as described herein with t-shaped keyways and key that slide into each other to reinforce and strengthen the mold as assembled, and to provide a continuous, sealed outer exposed surfaces of the cavity wall and the window. However, the inner part of the cavity wall contains large openings to allow the concrete fill to pass under the window and above the window in one operations as described herein. The mold may be vibrated to ensure that the concrete fills the cavity wall entirely. Additionally small holes may be provided for inspection to ensure complete filling of the cavity wall. FIG. 17C shows a view of the cavity wall/window structure taken vertically through the window. FIG. 17D shows the wall with the opening 169 from the front showing the outlines of the different mold assemblies.

Figure 18B:
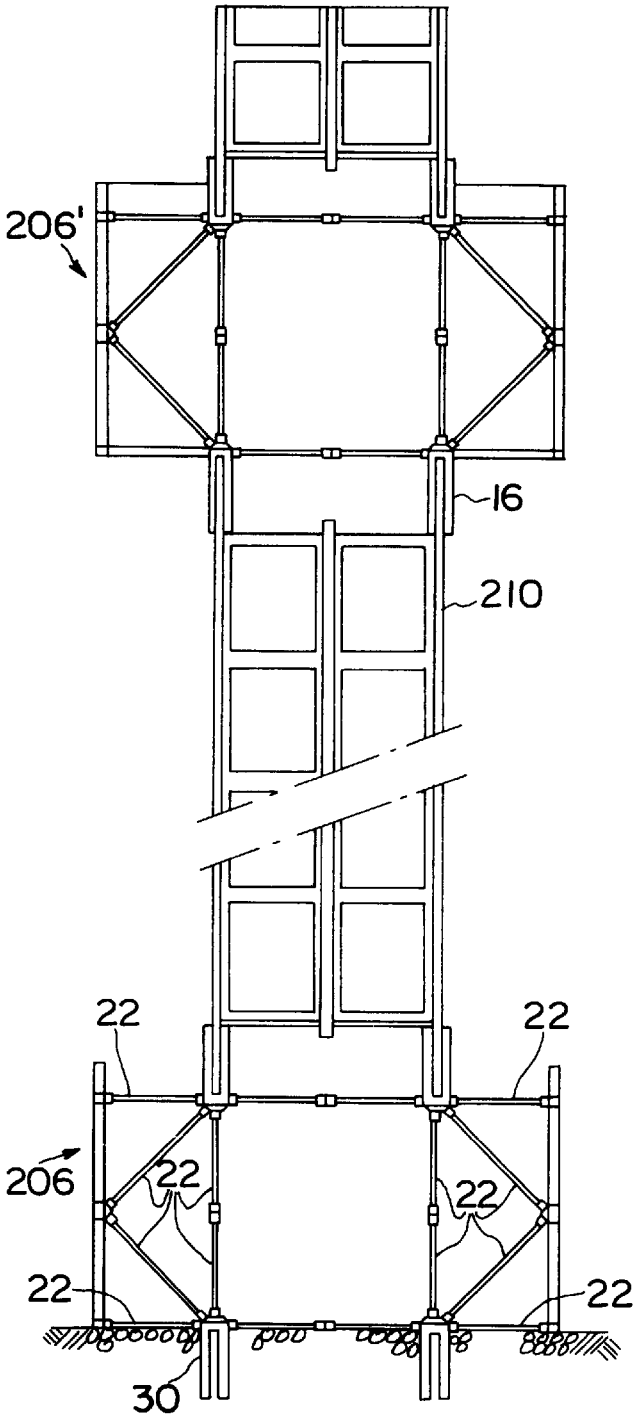
FIG. 18B, is a cross sectional view of a cavity wall column module.
Figure 18A:
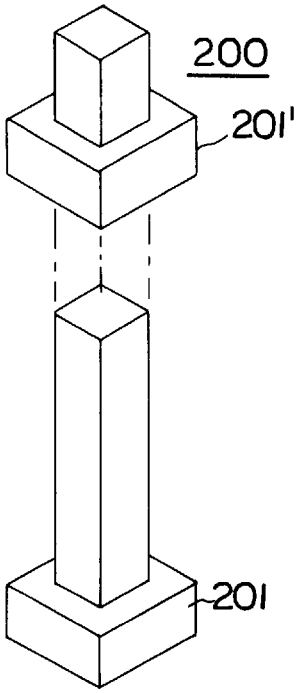
FIG. 18A is an isometric view of the monolithic concrete column and base cast within.

FIG. 18A shows an isometric view of a monolithic concrete column 200 with a base 201 and similar cap 201' extending outward from the column without mold apparatus. Base dimensions depend on the loading and size of the column, may be specified by the design engineer to be wider and deeper than shown in FIG. 18A to accommodate the column. The corresponding mold assembly shown in FIG. 18B with base assembly 206 and the cap assembly 206' are shown in cross section through the center of the column. The body of the column and the top of the column are constructed similarly to the cavity wall structures described before and will not be discussed here. The horizontal base and cap form a new element to structures described above.

With reference to FIG. 18B, end plates 16 are placed over the top ends of the wall panels 10 just below and supporting the horizontal section of the cap assembly 206'. The bottom, sides and top of the horizontal section of the cap assembly 206' are abbreviated cavity wall panel similar to item 10 in the earlier FIGS. Perforated footing plates 22 (see FIG. 10) form a triangular rigid cross section to support the structure when casting the concrete. A similar triangular section in the base supports and prevents the column base from moving when casting. The connections 22 are the steel tie sections with large openings to allow the concrete to flow into the horizontal sections of the cap and base. The top of the cap and the base have additional steel tie plates 22 for strength. The connection joints between the tie plates, the cavity wall panels, and the end panels are with the various configurations of hubs shown herein. Please note that the hub designs shown herein can be of other configurations to allow virtually any array of panels, tie plates, etc. to be interconnected at many different angles, lengths, etc. respectively, of a mold apparatus for a simple building including the structures described above, i.e. a footing assembly, door and window framed opening assemblies, columns assemblies with horizontal elements (see FIG. 18A), and cavity wall assemblies.

Figure 19A:
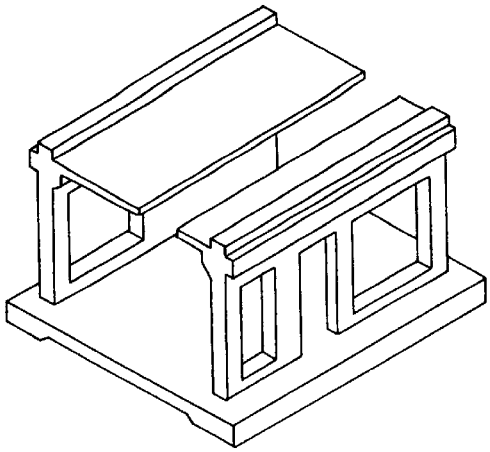
FIG. 19A shows an isometric view of a monolithic concrete building structure including footing, walls, openings in the walls and upper floor slabs cast within.

FIG. 19A is an isometric view of a monolithic concrete structure without a mold assembly apparatus similar to that of FIGS. 1A, 17A, and 18A with doors and windows, etc. but including a roof slab 161 (roof shown divided). The roof slab shown is intended to form the floor of the second story of this structure. Other stories may be added (not shown). Of particular interest is the truss/girder assembly 212 consisting of an upper and a lower flat surface spaced apart and interconnected by an array of hexagonal honeycomb webbing 224.

Figure 19B:
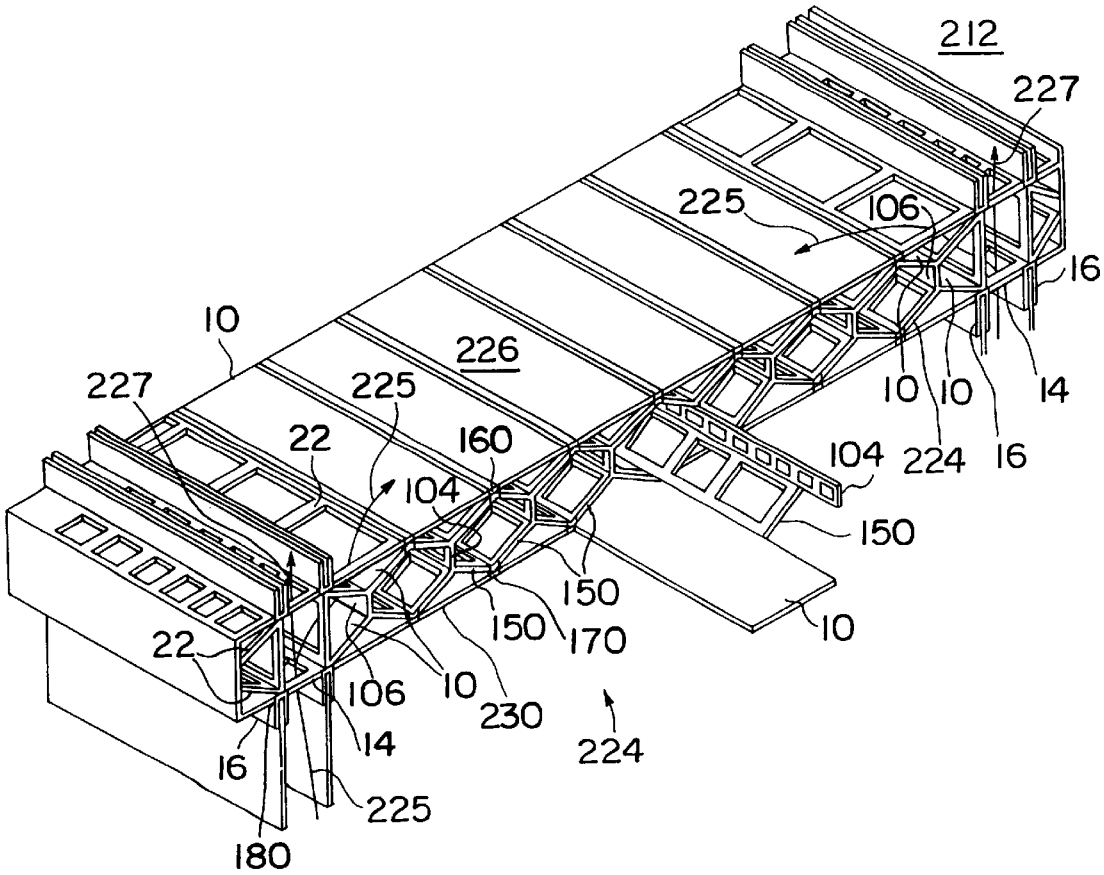
FIGS. 19B and 19C are views of a truss girder assembly attached to cavity wall and footing assemblies.

Referring to FIG. 19B, the upper flat surface 226 is comprised of a plurality of hollow core panel members 10 attached together by connecting hubs 160. The web/footing plates 22 nearest the wall are perforated such that concrete fill extends from the top of the walls through the horizontal tie plate 14, through the tie plates onto the top of the surface 226 as shown by the arrows 225 in FIG. 19C. The concrete over flows and covers the top surface 226 to a thickness determined by the design engineer. During this process the rate of placing the concrete fill is slowed to prevent the concrete fill as it flows 227 into the second story wall from forcing the concrete further onto the surface 226 disrupting the floor. The panels 10 adjacent to the perforated tie plates 22 are solid and connected by a solid web plate 106 preventing the concrete from entering the honeycomb structure within the floor truss 212 itself. The lower chord 230 is comprised of hollow core panel members 10 attached together by connecting hubs 170. The honeycomb webbing 224 is comprised of perforated web plates 150 which slidably engage protruding elements of connecting hubs 160 and 170 and slidably engage the protruding elements of the connecting web plate 104. The ends of the web plates 150 are attached to a perforated web connecting plate 104 on one end and the upper chord connecting hub 160 or lower chord connecting hub 170 at the other end. The perforated web connecting plate 104 has protruding keys that mate with corresponding keyways formed a the ends of the web plate 150. Other means of joining the various members together may be used. For example, other hubs with protruding elements extending from one another at different angles may be used to form the angles between web connecting members. At the edges of the truss/girder assembly, wall panel 10 connect the inner cavity wall end plate to the truss/girder 212 through connecting hub 180. The base end tie plate 16 of the second level cavity wall is attached to webbing of the truss/girder 212 by plate 22 through connecting hub 180.

Figure 19C:
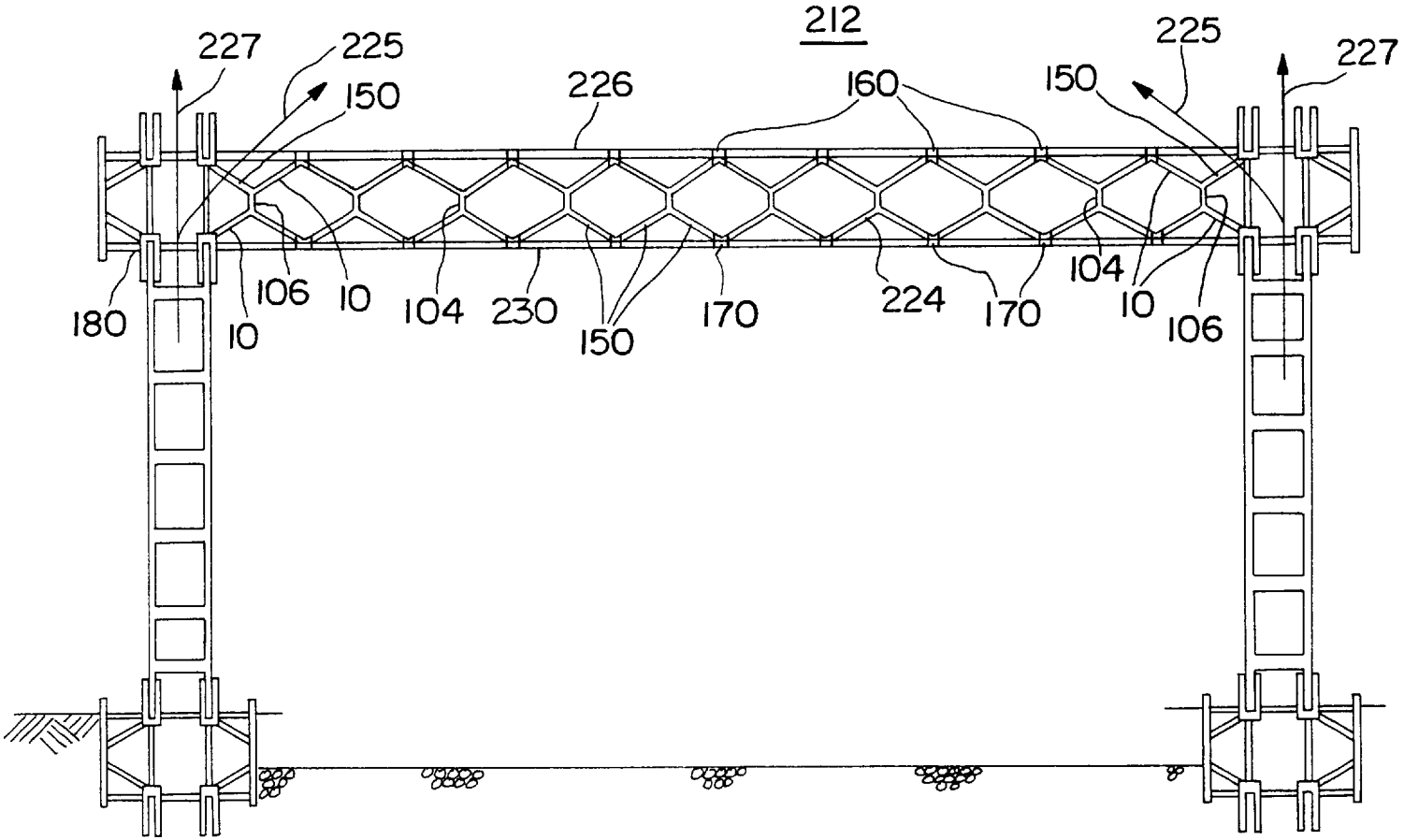

Still referring to FIG. 19C, the upper and lower chords flat surfaces of truss/girder assembly 212 are attached to cavity wall end plates by connecting hubs as described above. The first lower diagonal extending from hub 180 on top of the inner cavity wall end plate, and corresponding extension to the upper chord surface are comprised of hollow core wall panel 10. This design provides a solid transition structure from vertical cavity wall to horizontal platform which supports concrete fill 95 on top of the truss/girder 212 during casting. All other vertical and diagonal tie plates connecting the truss/girder assembly to the cavity wall assembly are comprised of perforated steel to allow unimpeded passage of concrete from cavity wall to top of truss/girder support platform. The floor is finished by methods as typical in the art.

If multi-level structures are to be constructed using the detailed methods and apparatus disclosed herein, the mold apparatus for the third and above levels will be constructed while the casting is proceeding on the lower levels. This is to prevent wind from toppling the mold assemblies. Since the casting process is performed on a time basis to allow the underlying concrete fill to set up, there is time to erect the mold apparatus for the upper levels. The mold apparatus should be pre-assembled at ground level away from the site for each of the upper levels to ensure that the all mold apparatus is present and of the proper dimensions. Of course, other techniques can be used to ensure that all the parts are present and functional.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A method for constructing an encased monolithic concrete structure in situ comprising the steps of:

erecting at least a first panelized mold assembly for a concrete footing, erecting at least a second panelized mold assembly for a vertical concrete structure, wherein each panelized mold assembly defines a void, joining said first and second panelized mold assemblies to each other forming an integrated self supporting panelized mold apparatus in situ, wherein the voids or cavities defined by each of the mold assemblies are in communication with each other thereby defining a void for the entire structure, placing concrete fill into said molded void for the entire structure, leaving said panelized mold apparatus in place to become an integral part of the completed monolithic structure.

2. The method of claim 1 wherein the step of placing concrete fill comprises the steps of:

substantially continuously placing concrete fill into said void for the entire structure, determining the strength of said panelized mold apparatus, calculating the setup time of the concrete once cast, and placing said concrete fill at a rate such that the earlier cast concrete fill has set up at a given depth below the present level of the concrete being placed and the hydrostatic pressure of the more recently cast concrete fill is substantially within said strength of said mold, and that said rate of subsequent placement maintains said given depth.

3. The method of claim 1 wherein the steps of erecting the first and the second panel assemblies and the step of joining of the panelized mold assemblies to each other comprise the steps of:

connecting and interlocking panels and end plates to connecting tie members and connecting hubs, and interlocking said first and second panelized mold assemblies to each other, said interlocked panelized mold assemblies defining a continuous panelized mold apparatus of the entire structure.

4. The method of claim 3 wherein the step of interlocking said first and second panelized mold assemblies to each other comprises the steps of:

forming a connecting tie plate with at least two means for interlocking distributed along each of the edges of the tie plate, wherein the two means along each edge attached to mating interlocking means formed in the edges of said panels, forming a hub with at least two means for interlocking distributed around the periphery of said hub, said means for interlocking designed and arranged to attach to mating interlocking means formed in the edges of said panels, forming a mating means for interlocking on said edges of said panelized mold assemblies, joining said panelized mold assemblies by mating the means for interlocking of the hub and the edges of the panelized mold assemblies, wherein said panelized mold assemblies and said hubs combine to form a continuous panelized mold apparatus.

5. The method of claim 4 wherein the forming of mating means for interlocking comprises the steps of:

forming keyways and mating keys or key extensions, and spanning the distance between said keyways and said mating keys with filaments to form a water tight seal therebetween.

6. The method of claim 5 further comprising the step of attaching said filaments to the outermost locations on said key extensions.

7. The method of claim 3 further comprising the steps of:

fabricating said panels and connecting hubs from water resistant material, and fabricating said tie plates at least partly from steel sheeting.

8. The method of claim 1 further comprising the step of:

erecting a third horizontal or canted panelized mold assembly attached to the second panelized mold assembly for supporting concrete fill, said third panelized mold assembly defining a bottom surface and defining a third void in communication with the void of said second panelized mold assembly, wherein the voids in said erected mold assemblies are in communication with each other, placing concrete fill in the second panelized mold assembly wherein said concrete fill passes into the void of said third panelized mold and onto the horizontal or canted surface, such that the concrete fill forms a monolithic concrete structure.

9. The method of claim 8 further comprising the step of: connecting said opposing panelized sections of said mold assemblies to each other with connecting members, wherein the connecting members strengthen the entire panelized mold assembly in order to contain and support the concrete fill during casting.

10. The method of claim 9 wherein the step of connecting said opposing and adjacent panelized sections includes the steps of:

providing a tie member designed and constructed to provide an interconnection between the edges of adjacent panels to form a solid continuous panelized wall, providing a tie member designed to traverse the void between said opposing portions of said panelized mold assemblies, providing interlocking means on the edges of said tie members, providing interlocking means on the opposing and adjacent panelized sections, wherein said tie members connect said opposing panelized sections to each other such that the finished mold is self supporting.

11. The method of claim 1 further comprising the step of:

forming members of said panelized mold assemblies as hollow panels with two outer surfaces and having a webbing in said hollow volume between said outer surfaces, and where said webbing forms interstices.

12. The method of claim 11 further comprising the steps of: filling said interstices with insulation or strengthening grout.

13. The method of claim 11 further comprising the step of installing utility lines into said interstices.

14. An encased monolithic concrete structure in situ comprising:

at least one first panelized mold assembly for a concrete footing, at least one second panelized mold assembly for a vertical concrete wall structure, wherein each panelized mold assembly defines a void between opposing panelized mold sections, at least one third panelized mold assembly located at the top of the second mold assembly, said third mold assembly defining a second floor or roof of said concrete structure, wherein said first and second and third panelized mold assemblies are joined to each other forming an integral self supporting panelized mold apparatus in situ, wherein the void or cavity defined by each of the mold assemblies are in communication with each other thereby defining a void for the entire structure, and concrete fill cast into said void for the entire structure, wherein said integrated self supporting panelized mold apparatus is left in place upon completion of the casting operation to protect said concrete structure.

15. The structure of claim 14 further comprising:

means for substantially continuously placing concrete fill into said void for the entire structure, means for determining the strength of said panelized mold apparatus, means for calculating the setup time of the concrete once cast, and means for placing said concrete fill at a rate such that the earlier cast concrete fill has set up, at a given depth below the present level of the concrete being placed, to be self supporting and the hydrostatic pressure of the more recently cast concrete fill is substantially within said strength of said mold, and that said rate of subsequent placement maintains said given depth.

16. The structure of claim 14 further comprising:

interlocking panels, interlocking tie plates and interlocking hubs, connecting said interlocking panels, tie plates and hubs together to form said first and second and third panelized mold assemblies together to form said entire mold assembly.

17. The structure of claim 16 further wherein said means for interlocking comprising:

keyways and mating keys or key extensions, and filaments spanning the distance therebetween to provide a water tight seal.

18. The structure of claim 14 wherein the means for interlocking comprises:

a connecting tie plate member with at least four means for interlocking with two said means for interlocking distributed along each edge of the tie plate, said two means for interlocking designed and constructed to provide an interconnection between the edges of adjacent panels to form a solid continuous panelized wall, a hub with at least two means for interlocking distributed around the periphery of said hub, said means for interlocking designed and arranged to attach to the mating interlocking edges of said panelized mold assemblies, mating means for interlocking on said edges of said panelized mold assemblies, such that said panelized mold assemblies are joined to each other by mating the means for interlocking of the hub and the edges of the mold assemblies, wherein said panelized mold assemblies and said hubs combine to form a continuous panelized mold apparatus.

19. The structure of claim 14 wherein the panelized mold assemblies comprise water resistant material and the tie plates comprise at least partly steel sheeting.

20. The structure of claim 14 further comprising:

at least one third panelized mold assembly for supporting concrete fill cast horizontally and attached to the second panelized mold assembly, said third panelized mold defining a bottom surface of a horizontal or canted concrete slab and defining a third void in communication with the void of said second panelized mold assembly, wherein the voids in said erected mold assemblies are in communication with each other, and wherein concrete fill in the second panelized mold assembly passes through to the third void onto said horizontal surface, such that the concrete fill forms a monolithic concrete structure.

21. The structure of claim 14 further comprising:

means for connecting said adjacent and opposing panels of said panelized mold assemblies to each other simultaneously, wherein the means for connecting strengthen the entire panelized mold assembly in order to contain and support the concrete fill during casting.

22. The structure of claim 21 wherein said means for connecting comprises:

vertical tie slates designed and constructed to traverse the void between opposing panels and to join adjacent panels together simultaneously, interlocking means on the edges of said tie members, wherein said interlocking means of said vertical tie plates are designed and constructed to provide an interconnection between the edges of adjacent panels to form a solid continuous panelized wall and to join opposing panelized sections to each other such that the finished panelized mold is self supporting.

23. The structure of claim 14 further wherein members of said panelized mold assemblies comprise:

hollow panels with two outer surfaces and a webbing in said hollow between and joining said outer surfaces, and where said webbing forms interstices.

24. The structure of claim 14 further comprising insulation or strengthening grout filling interstices of said panelized mold assemblies.

25. The structure of claim 14 further comprising utility lines placed in interstices of said panelized mold assemblies.

26. Panelized mold assembly apparatus for constructing a monolithic concrete structure in situ comprising:

at least a first panel at least a second panel positioned opposing said first panel at a distance defining a void, perforated means for joining said opposing panels to each other such that said distance is maintained when concrete fill is placed in said void, and perforated horizontal tie plate means arranged at least one at the top or the bottom of said structure, wherein said perforations allow free passage of concrete fill therethrough.

27. The apparatus of claim 26 further comprising panels adjacent to said first panel joined in an interlocking manner along the adjacent edges of each of said panels.

28. Apparatus for constructing an encased monolithic concrete structures in situ comprising:

panelized mold assemblies defining an entire structure, said structures having at least a footing and at least one wall connected to the footing and at least one horizontal mold structure connected to the top of said wall to form a second floor or roof to said concrete structure, wherein said connected panelized mold assemblies define voids that are in communication with each other, and means for connecting adjoining panelized mold assemblies in situ in an interlocking fashion such that the assembled mold apparatus of the entire structure is self-supporting, and where said panelized apparatus serve as the finished interior and exterior surfaces of the walls.

29. The apparatus of claim 28 wherein said mold apparatus for the entire structure includes panel members, connecting hubs, tie plates and end plates where adjacent mold members are interconnected in an interlocking fashion to form assemblies, and said assemblies are interconnected in an interlocking fashion to create a mold apparatus for an entire structure.

30. The apparatus of claim 29 further comprising:

opposing panels, said panels arranged defining distal surfaces of said panels, said distal surfaces designed to serve as the exterior surfaces of the completed concrete walls and ceilings, perforated tie plates, said tie plates, connecting said adjacent and opposing panels to each other thereby holding and retaining said adjacent and opposing wall panels and said tie slate in a fixed position relative to each other.

31. The apparatus of claim 28 further comprising:

a plurality of said panels and said tie slates, end plates arranged and constructed to accept the top and the bottom edges of each of said panels and tie plates, and perforated horizontal tie plates designed to connect said end plates at the top and bottom of said edges to each other, thereby holding said panelized mold assembly together in a fixed manner.

32. The apparatus of claim 30 wherein all adjacent said panels, vertical tie plates, end plates and horizontal tie plates join to each in an interlocking fashion, and wherein said perforations allow concrete in its plastic form to invade all wall voids within said apparatus and to flow directly from said wall void onto said floor and roof assemblies forming an encased monolithic structure.

33. The apparatus of claim 31 wherein said connecting hubs comprise:

a core defining at least one edge and along said edge at least one means for interlocking with a mating interlocking edge of another mold member.

34. The hub of claim 33 wherein the core defines a length and a corresponding axis and where a plurality of said means for interlocking extend axially along said core length, each means for interlocking positioned from one another at different angles with respect to each other and to said axis.

35. A mold for a cavity wall suitable for filling the cavity with concrete comprising:

opposing and adjacent hollow panel members defining at least one edge in a longitudinal direction, perforated tie plate members positioned between opposing and adjacent panel members, means distributed along said longitudinal direction of said panel member for removably connecting or joining said panel member to a corresponding means on an adjacent panel member, means distributed along said tie plate member in said longitudinal direction of said panel for removably connecting or joining said tie plate member to a corresponding means on an adjacent panel member, means distributed along said longitudinal direction of said panel member for removably connecting or joining said panel member to said corresponding means for joining of said tie plate member.

36. The mold of claim 35 wherein said means for removably connecting comprises a tongue on a member and groove on an adjacent member, wherein said tongue slides longitudinally into said adjacent groove to provide a locking connection.

37. Apparatus for building and encased monolithic concrete structure in situ comprising:

at least one first panelized mold assembly for a concrete footing, at least one second panelized mold assembly for a vertical concrete wall structure, wherein each panelized mold assembly defines a void between opposing panelized mold sections, at least one third panelized mold assembly located at the top of the second mold assembly, said third mold assembly defining a second floor or roof of said concrete structure, wherein said first and second and third panelized mold assemblies are joined to each other forming an integral self supporting panelized mold apparatus in situ, wherein the void or cavity defined by each of the mold assemblies are in communication with each other thereby defining a void for the entire structure, means for substantially continuously placing concrete fill into said void for the entire structure at a rate within the strength of the entire joined mold assemblies, means for determining the strength of said panelized mold assemblies, means for calculating the setup time of the concrete once cast, and means for placing said concrete fill at a rate such that the earlier cast concrete fill has set up, at a given depth below the present level of the concrete being placed, to be self supporting and the hydrostatic pressure of the more recently cast concrete fill is substantially within said strength of said mold, and that said rate of subsequent placement maintains said given depth as the entire monolithic structure is cast.

* * * * *